United States Patent [19]

Owen et al.

[11] Patent Number: 4,549,243

[45] Date of Patent: Oct. 22, 1985

[54] SPRAYING APPARATUS

[75] Inventors: David J. Owen; Colin G. MacLaine, both of Cleveland, England

[73] Assignee: Imperial Chemical Industries, Hertfordshire, England

[21] Appl. No.: 589,221

[22] Filed: Mar. 13, 1984

[30] Foreign Application Priority Data

| | | | |
|---|---|---|---|
| Mar. 25, 1983 | [GB] | United Kingdom | 8308346 |
| May 20, 1983 | [GB] | United Kingdom | 8313959 |
| Aug. 18, 1983 | [GB] | United Kingdom | 8322308 |
| Oct. 5, 1983 | [GB] | United Kingdom | 8326666 |

[51] Int. Cl.[4] ..... B05B 5/02

[52] U.S. Cl. ..... 361/228; 361/226; 361/227; 361/235; 239/690

[58] Field of Search ..... 361/225, 226, 228, 227, 361/235; 239/690

[56] References Cited

U.S. PATENT DOCUMENTS

| | | | |
|---|---|---|---|
| 3,060,429 | 10/1962 | Winston . | |
| 3,887,928 | 6/1975 | Ohno et al. . | |
| 3,968,498 | 7/1976 | Uchiyama . | |
| 4,165,022 | 8/1979 | Bentley et al. | 361/235 X |
| 4,476,515 | 10/1984 | Coffee | 361/228 X |
| 4,495,541 | 1/1985 | Magee et al. | 361/225 |

FOREIGN PATENT DOCUMENTS

| | | | |
|---|---|---|---|
| 1198480 | 7/1970 | United Kingdom | 239/15 |
| 1444383 | 7/1976 | United Kingdom . | |

*Primary Examiner*—Harry E. Moose, Jr.

*Attorney, Agent, or Firm*—Cushman, Darby & Cushman

[57] ABSTRACT

Electrostatic spraying apparatus e.g. for graphic work, having a hand or finger held body carrying a nozzle to which the atomizing potential is applied from a high voltage generator. The nozzle is of the non-drip type, e.g. a capillary bore or a felt- or fibre-tip so that no liquid is dispensed therefrom in the absence of the atomizing potential. The nozzle and liquid reservoir may be a cartridge, e.g. a felt-tip graphic marker. The generator may be within the body so as to provide a self-contained unit which can be "earthed" via the user's hand.

17 Claims, 9 Drawing Figures

SPRAYING APPARATUS

This invention relates to spraying apparatus, and in particular to spraying apparatus that can be held in the human hand preferably between the digits thereof, for applications such as graphic work where it is desired that the area to which the spray is applied can be precisely controlled.

One form of digit held spray applicator that has been used heretofore for graphic work is the so-called "air-brush"—wherein an applicator having a body member designed to be held between the digits of the human hand is provided with a nozzle through which the liquid may be dispensed from a reservoir as a spray. The applicator is connected, generally via a flexible tube, to a source of propellant for atomising the liquid as a spray from the nozzle. The propellant source is typically an air compressor or a canister of liquified, compressed, gas. Suitable air compressors tend to be relatively bulky, noisy and expensive while canisters of propellant become exhausted relatively quickly thereby presenting considerable operating expense. Such air-brushes, although somewhat cumbersome, are however widely used by those engaged in graphic work, e.g. designers, artists, signwriters, model makers, and decorative coach workers.

In graphic work, e.g. drawing or writing, marking implements employing liquid inks have a nozzle, and ink supply thereto, of the type that, when the nozzle is in contact with a surface beneath the nozzle that is receptive to the ink and is moved relative to, but in contact with the surface, ink is transferred from the nozzle on to the surface, but when the nozzle is disposed above, and out of contact with, a surface, no ink is dispensed from the nozzle.

Such marking impliments include fountain and ball point pens, and markers employing a porous wick-type nib comprising a felt, or plastic, pad, or fibre bundle, e.g. felt- or fibre-tip pens and graphic markers for example of the type described in UK patent specification No. 628350.

We have found that liquids can be caused to spray from nozzles of this type of construction.

In the apparatus of the present invention, the spray is effected electrostatically by applying a sufficiently large electrical potential, relative to earth, to the nozzle.

It is known, for example from U.S. Pat. No. 4,356,528, that a liquid can be electrostatically sprayed by applying a high potential to a nozzle from which the liquid is to be sprayed so as to cause the liquid to atomise as a spray of electrically charged droplets. However in the arrangement described in that U.S. patent, the applied potential effects atomisation of liquid that is flowing, e.g. dripping, from the nozzle, e.g. by gravity flow.

It has also been suggested in "Naturwissenschaften" 40 (1953) page 337 that the application of a sufficient potential can effect atomisation of a liquid supported by surface tension in an upwardly directed nozzle of capillary dimensions.

The present invention is based on an appreciation that a combination of these teachings can provide a useful precision spraying apparatus.

Accordingly the present invention provides apparatus for spraying a liquid comprising (i) an elongated body member, suitable for holding in the human hand, provided with a nozzle at one end, (ii) means for delivering the liquid to said nozzle, (iii) a high voltage generator, and (iv) means for applying a sufficiently large electrical potential, relative to earth, from said generator to said nozzle that, when said body member is held in the human hand with the nozzle at a distance of 2 cm above an earthed surface, sufficient electrical gradient is provided at said nozzle to atomise said liquid as a spray of electrically charged droplets, said nozzle and said means for delivering the liquid thereto being of the type that, when said nozzle is in contact with a surface beneath the nozzle that is receptive to said liquid and moved relative to, but in contact with, said surface, liquid is transferred from said nozzle on to said surface, but when said nozzle is disposed above, but out of contact with, a surface and no atomising electrical potential is applied to said nozzle, no liquid is dispensed from said nozzle.

The nozzle has one or more orifices from which the liquid is dispensed on application of the high potential. The orifices may be irregular, circular, or annular, for example as provided by a needle or wire disposed substantially concentrically within a circular opening. Typically, in such cases, the orifice cross-sectional area is in the range 0.01 to 1 $mm^2$.

Another form of nozzle member comprises a porous wick material protruding from a support. The types of porous felt or plastic pads or fibre bundles widely used in graphic implements such as felt- or porous plastic-tip markers or felt- or fibre-tip pens are eminently suitable as the wick material. In such cases the cross-sectional area of the porous wick can be considerably larger than aforesaid, for example up to 1 cm square.

The nozzle configuration is determined by the requirement that the liquid does not flow, e.g. drip, therefrom in the absence of an applied high potential and in the absence of a contacting surface. This requirement is affected by the nozzle cross-sectional area, the nature of any porous wick, the nature of the liquid, e.g. its surface tension and the pressure to which the liquid is subject, e.g. the head of liquid in the liquid delivery means.

The nozzle configuration may have some effect on the nature of the electrical field at the nozzle and hence on the shape of the spray produced: in the case of a porous pad or fibre bundle nozzle construction, it may be preferable to employ a pad or bundle having a point, hemispherical, or "bullet head" configuration.

To obtain satisfactory spraying it is preferred that the nozzle configuration is such that the air-liquid interface at the nozzle has at least one radius of curvature below 5 mm, particularly below 2 mm.

The nozzle configuration may affect the volumetric flow of liquid through the nozzle when the potential is applied and hence the volumetric spraying rate. To vary the flow rate the nozzle may be demountable from the body member so that it can be exchanged for another nozzle of differing configuration. The viscosity of the liquid will also affect the volumetric flow rate. If desired, provision may be made for varying the volumetric flow rate of liquid through the nozzle by means of a suitable valve, e.g. a needle valve, controlled e.g. by rotation of a portion of the body member or by a slider thereon. Such a valve need not modify the size of the nozzle orifice but may be positioned to form a variable flow restriction upstream of the nozzle.

Some forms of graphic implements, e.g. ball-point pens, rely upon movement of a component, e.g. a ball, relative to a housing therefor to "pump" the ink through the orifice between the component and its housing to transfer the ink on to that surface of the component that contacts the ink-receptive surface on which it is desired to make a mark. The relative movement occurs when the component is moved across the ink-receptive surface. In the present invention when using this form of nozzle construction, since, during spraying, there is no contact with the surface to be sprayed, movement of the nozzle relative to the surface being sprayed does not effect that movement of the component relative to its housing and hence the "pump" action does not occur. Therefore to enable such nozzles to be employed, the nature of the liquid should be such that it would flow through the orifice formed by the space between the component and its housing, upon contact, and relative movement, of that orifice, rather than the surface of said component, with an ink receptive surface beneath the orifice without relative movement between said component and its housing.

The body member is shaped so that it is suitable for holding in the human hand. To this end the body member is elongated and preferably has at least one cross-sectional dimension below 10 cm. Preferably the maximum cross-sectional dimension is below 10 cm. For fine scale work the body member is preferably shaped so that it may be held between the digits of the human hand. Thus it may be held between the thumb and one or more fingers or between adjacent fingers depending on the user's preference. To this end the body member preferably has at least one cross-sectional dimension below 4 cm, particularly within the range 0.5 to 3 cm. The total length of the body member is preferably between 4 and 25 cm, particularly between 5 and 20 cm. It is preferred that the total length of the body member plus nozzle member is below 25 cm.

The body member is preferably constructed from an electrically insulating material, e.g. a suitable plastics material but, as mentioned hereinafter, its surface preferably has an electrically conductive portion.

The means for supplying the liquid to be sprayed to the nozzle will generally comprise a reservoir for the liquid and a fluid connection from the reservoir to the nozzle.

The reservoir may be within the body member or may be mounted on the surface thereof. The reservoir may comprise a cartridge, which may be refillable, which can be disconnected from the body member so that the reservoir can be replaced.

Alternatively the reservoir may be remote from the body member and connected thereto by a flexible tube. Where the reservoir is mounted in, or on, the body member, feed of liquid to the nozzle is preferably effected by capillary action, e.g. by a wick of porous material extending from the nozzle to the reservoir. The reservoir may be a wad of absorbent material, e.g. felt or wadding impregnated with the liquid, within a suitable casing. Where the reservoir is remote from the body member, the reservoir may be pressurised to supply the liquid to the nozzle. Alternatively a pump may be used to supply the liquid to the nozzle.

It will be appreciated however that, if the supply of liquid is pressurised, or a pump is employed, the pressure on the liquid must be insufficient to overcome the forces, e.g. surface tension forces, preventing flow of liquid from the nozzle when the high potential is not applied to the nozzle and the nozzle is not in contact with a liquid receptive surface.

There may be provision for the simultaneous connection of a plurality of reservoirs to the body member in which case, one or more valves may be provided to regulate the flow from the reservoirs. Where there are two reservoirs, a single valve is preferably provided to vary the relative proportions of liquid flowing from each reservoir: the use of such a valve enables gradual colour changes to be obtained in graphic work on a workpiece by gradually changing from liquid of one colour from one reservoir to liquid of another colour from a second reservoir as spraying is conducted.

In common with "air-brushes", the apparatus described hereinbefore presents some cleaning problems: although it can be cleaned by changing the spray liquid to a suitable cleaning solvent, and continuing spraying, this is wasteful of cleaning solvent and also is time consuming. Except where, as is described hereinbefore, the body member is provided with a plurality of reservoirs with valve means to control the flow of liquid therefrom and to permit gradual change from one reservoir to another, changing from spraying one liquid to another may also necessitate an intermediate cleaning operation. These problems can however be avoided in one preferred form of the invention wherein the reservoir and nozzle constitute a single cartridge unit which can be removed from the body member and exchanged for another cartridge. The cartridge in such cases is conveniently a felt- or fibre-tip applicator, for example a felt- or fibre-tip marker of the type widely used in graphic work.

In this form of the invention it is necessary that the body member is provided with a contact to apply the high potential from the high voltage generator (which may be within the body member or remote therefrom) to the cartridge. If the cartridge is of an electrically conductive material, then the high potential is conducted either directly to the nozzle or through the cartridge walls to the liquid therein and thence, by conduction through the liquid, to the nozzle. Even where the cartridge is manufactured from a poor conductor, in many cases a sufficiently high potential can be applied to the nozzle via conduction over the cartridge surface. However it is preferred in such a case to provide an electrical connection directly to the nozzle or to the liquid within the cartridge. Where the liquid reservoir is liquid absorbed on a suitable wad within the cartridge, such a connection can be effected by inserting a suitable conductive stud, e.g. a metal drawing pin, through the wall of the cartridge so that the stud contacts the liquid impregnated wad.

Therefore in accordance with a further aspect of the invention, there is provided apparatus for use in the spraying of a liquid from a cartridge having a casing enclosing a reservoir of the liquid and a nozzle of the type that, when said nozzle is in contact with a surface beneath the nozzle that is receptive to said liquid and is moved relative to, but in contact with, said surface, liquid is transferred from said nozzle on to said surface, but when said nozzle is disposed above, but out of contact with, a surface and no atomising electrical potential is applied to said nozzle, no liquid is dispensed from said nozzle, comprising (i) an elongated body member, suitable for holding in the human hand, and adapted to receive said cartridge with the nozzle thereof projecting from one end of said body member, (ii) a high voltage generator, and (iii) means to apply a sufficiently large electrical potential, relative to earth, from said generator to said cartridge, when said cartridge is fitted to said body member, that, when said body member is held in the human hand within the nozzle of a cartridge, at a distance of 2 cm above an earthed surface, sufficient electrical gradient is provided at said nozzle to atomise said liquid as a spray of electrically charged droplets.

In a preferred form of the invention, the body member is adapted to receive cartridges of more than one shape and/or size. To enable such cartridges to be employed, there may be provided one or more adaptor components which are fitted as necessary to the body member to locate and/or hold different cartridges in position and/or to enable adequate electrical connection to the differing cartridges to be made.

The apparatus of the invention includes means for applying a high potential, relative to earth, to the nozzle or to a contact which, when a cartridge containing the nozzle is connected to the body member, enables a high potential to be applied to the nozzle.

The high potential is provided by a suitable high voltage generator which may be a piezo-electric generator operated by movement of a suitable component, e.g. a push button or trigger, or a mains, or, particularly, battery powered generator.

The generator may be mounted in or on the body member, or may be remote therefrom. Where a battery powered generator is mounted in the body member, it is preferred that the body member also accomodates the necessary batteries.

Where the generator is remote from the body member or is powered from a source remote from the body member, an electrical connection, e.g. a flexible lead, is required from the remote generator, or power source, to the body member. Where the liquid reservoir is also remote from the body member, the high voltage from a remote generator may be applied to the liquid in the reservoir and the potential applied to the nozzle from the liquid in the reservoir via conduction through the liquid in the fluid connection from the reservoir to the body member.

The generator is conveniently of the type employing a transformer to produce high voltage pulses at a frequency of from 1 Hz to 20 kHz. Such a generator should be provided with a rectifier to avoid pulses of opposite polarity, e.g. as obtained as a result of "ringing", from being applied to the nozzle. Preferably the high voltage circuit has sufficient capacitance that, during use, the desired electrical gradient at the nozzle is maintained between pulses but on the other hand should have a low stored energy, preferably less 10 mJ, so that no safety hazard is presented to the user for example by accidental contact of the user with the nozzle or on contact of the nozzle with an earthed surface.

The appropriate capacitance may in some cases be provided by the capacitance between the liquid reservoir and/or its casting and an earthed member, e.g. the user, rather than by a discrete capacitor component.

It is necessary that the high voltage generator is capable of applying a sufficient potential, relative to earth, to the nozzle that, when the nozzle is held spaced 2 cm above an earthed surface, the liquid is atomised from the nozzle as a spray of electrically charged droplets. It will be appreciated that the applied potential will generally be such as to enable spraying to occur over a range of distances of the nozzle from an earthed surface. The potential required at the nozzle to effect such spraying will depend on the nature of the liquid, e.g. its resistivity and the nozzle configuration but will generally be within the range 1 to 25 kV, in particular between 5 and 20 kV, and may be negative, or, preferably, positive with respect to earth.

The field strength at the nozzle is preferably such that the liquid is drawn from the nozzle as one or more charged ligaments which then break up into the spray of charged droplets.

When a nozzle with a high potential applied thereto is brought close to an earthed surface, spark discharges from the nozzle to the earthed surface may occur instead of spraying. It is preferred that the field strength at the nozzle is such that the maximum distance of the nozzle from an earthed surface at which spark discharges occur is less than 5 mm. At greater distances the field strength is insufficient to cause spark discharges but is sufficient to atomise the liquid as it leaves the nozzle as a spray of fine, electrically charged, droplets. As the nozzle is moved further away from the earthed surface, eventually the field between the nozzle and that surface will drop below that necessary to cause atomisation. We prefer that the field strength at the nozzle is such that the distance at which spraying ceases is not more than 30 cm, particularly not more than 15 cm.

It is seen that, for a given applied potential, spraying can be caused to stop by moving the nozzle a sufficient distance away from the earthed surface: also, when the nozzle is in contact with the earthed surface, liquid can be deposited thereon by moving the nozzle, in contact with the surface, relative thereto; i.e. in the manner of a conventional marking or writing implement.

Provision may be made for varying the potential applied to the nozzle, for example by varying the generator output, e.g. the frequency of production of high voltage pulses and/or their magnitude. This is advantageous since it enables fine, narrow, sprays to be produced, by using relatively low voltages, e.g. 1–5 kV, when the nozzle is close to the earthed surface: by increasing the nozzle potential, e.g. to 8–15 kV, a broader spray can be obtained with the nozzle at greater distances from the earthed surface. If the higher potential were to be applied with the nozzle close to the earthed surface, a fine enough spray might not be obtainable because of the occurrence of spark discharges.

For applications such as graphic work, the nozzle will generally be held at a distance within the range 0.5 to 10 cm from a workpiece. The latter should have sufficient surface and/or volume conductivity that there is rapid dissipation to earth of the charge transferred thereto by the charged droplets alighting thereon.

Paper, thin card, and metals are suitable work pieces, even if they already have a layer of paint of lacquer thereon. Thus the apparatus may be used for applications such as coach-lining, touch-up painting, workpieces such as automobiles as well as normal graphic art work. For many applications the workpiece will be supported on a work-top, e.g. a drawing board, on which graphic work is performed and providing this work-top is not an insulator, sufficient charge dissipation to earth can take place. Preferably the support is wood, metal, graphite filled plastics material, or a non-conductive material support provided with a conductive surface layer e.g. aluminium foil or metallised plastics film fastened, e.g. laminated, to the support.

An electrical connection, to form a return path, is required between the generator and the workpiece. Where the generator and/or its power source, is remote from the body member this connection will normally be provided by a direct connection, or via the earth. Where the generator is mounted within the body member, sufficient electrical continuity to earth can normally be provided by conduction through the user's hand holding the body member thus obviating the need for an electrical lead from the generator to earth. Conduction from the generator to earth via the user can be facilitated by providing a conductive portion on the body member surface, which portion is connected to the generator and to which contact is normally made by the user's hand during spraying.

A switch will normally be provided to switch the high potential applied to the nozzle on and off. This switch may be, for example, an electronically operated touch sensor switch or a push button or slide switch, provided on the body member or may be a switch, e.g. foot operated, remote from the body member. In general the high voltage generator will be powered by a relatively low voltage source e.g. the mains or batteries and it is preferred that the switch is located in the low voltage circuit.

Where the switch is hand operated the portion of the switch contacted by the user during spraying may be electrically conductive and connected to the generator in order to facilitate the earth connection of the generator.

It will be appreciated that when spraying is taking place, there will be a reduction in the potential difference between the nozzle and earth from that potential difference between the nozzle and earth that exists when no spraying is taking place, i.e. when the electrical gradient at the nozzle is insufficient to cause atomisation. This reduction results from a number of factors:

(i) the impedance of the return path from the earth to the generator. Where this impedance is low the effect on the potential difference between the nozzle and the substrate may be insignificant. However where the return path has a significant impedance, e.g. where the workpiece has a relatively low conductance and/or the return path includes conduction through the user, the potential difference across the return path, and hence the reduction in potential difference between the nozzle and workpiece may be significant.

(ii) the impedance between the high voltage generator and the nozzle. A significant potential difference reduction between the nozzle and workpiece may occur if this impedance is high, for example where the high voltage is applied to the nozzle from the generator via conduction over the surface or through a cartridge made of a poor conductor.

(iii) the impedance of the leakage return path from the nozzle to the generator. This impedance acts as a shunt to the spray current and so may result in a significant potential difference reduction between the nozzle and substrate, particularly if the "forward" impedance from the generator to the nozzle is high.

It is preferred that generator output voltage and the aforementioned impedances are such that this reduced potential difference between the nozzle and earth is sufficient, preferably above 1 kV, and in particular above 5 kV, to permit spraying to continue so that spraying is continuous rather than intermittent.

The spray current, i.e. the current flowing as a result of the transfer of the charged atomised liquid droplets from the nozzle, will generally be within the range 1 to 5000, and usually below 1000 nA.

Masking of the workpiece can be achieved by means of an insulating material, e.g. a plastics film, disposed over those parts of the workpiece that it is desired not to spray. Where the mask is placed over the workpiece it will usually be held firmly in place by the electrostatic charges induced when the applicator is brought near to the mask. Masking can also be achieved by the use of an earthed electrically conductive material placed over the workpiece: if the mask is insulated from a workpiece of relatively poor conductivity, e.g. paper or card, although the mask may become contaminated by the spray, the spray will be repelled in the vicinity of the edges of the mask leaving an unsprayed portion of the workpiece not only under the mask but also around the mask edges. Also, with a workpiece of relatively poor conductivity, textured effects can be achieved by positioning an earthed, suitably textured, conductive member under the workpiece.

The apparatus of the present invention is of particular utility for graphic work, particularly using a system wherein a conventional graphic marker, e.g. a felt or fibre-tip applicator is used as a cartridge in a body member which is preferably self contained in the sense that the body member contains the high voltage generator and, if the latter is electrically powered, rather than of the piezo-electric type, batteries to power the generator. The liquid that may be used include any liquids that may be dispensed by such markers e.g. inks, which are preferably spirit based, lacquers and varnishes. Where the nozzle is of a type wherein solid particles in the liquid will not be filtered out during passage through the nozzle, e.g. where the nozzle is merely a bore of small cross-sectional dimensions, other liquids such as suspensions, e.g. paints and enamels can be used for graphic applications. While aqueous inks, e.g. indian ink can be used, it is preferred to employ non-aqueous liquids having a resistivity above $10^4$, and in particular between $10^7$ and $10^{12}$ ohm-cm.

The liquid typically has a viscosity within the range $10^{-4}$ to $10^{-1}$ Pa.s and a surface tension of $10^{-2}$ to $10^{-1}$ N/m.

While of primary application to graphic work, the apparatus of the invention may also be used for the localised spray application of other products, for example pesticides e.g. on to houseplants; anaesthetics; antiseptics and other pharmaceutical preparations, e.g. for the treatments of wounds or skin blemishes; personal hygiene products; cosmetics; perfumes; demisting liquids; lubricating oils; adhesives; and dry cleaning fluids e.g. grease spot removers.

While the apparatus is capable of spraying when held at 3 cm above an earthed surface, in some cases it may be desired to spray the liquid simply into the atmosphere, e.g. where the liquid is an insecticide, such as a flykiller, or a perfume or air freshener rather than on to a workpiece. For such applications it is necessary that an earthed member, which may in some cases be the user's hand, is sufficiently near to the nozzle to act as a field intensifying electrode as described in aforesaid U.S. Pat. No. 4,356,528. However for such cases it is preferred that an electrode is positioned adjacent to, but spaced from the nozzle, preferably upstream thereof, with an earth connection from said electrode, e.g. via the user. If desired provision may be made for varying the position of this electrode.

The provision of a field intensifying electrode may, in some cases, also be desirable in a graphic implement as it will enable spraying to continue when the nozzle is a considerable distance from the workpiece: this is of benefit if it is desired to apply the liquid to relatively large workpiece areas, e.g. to colour background areas. The field intensifying electrode may also have an effect on the shape of the spray.

It may be desirable to provide a switch, e.g. a push button or slide switch, on the body whereby the electrical connection to the field intensifying electrode to earth may be made or broken. Where connection of the field intensifying electrode to earth is made via the user, the body member may be provided with an electrically conductive portion on its surface connected to the field intensifying electrode: connection of the field intensifying electrode to earth via the user will then be made when the user contacts the electrically conductive portion of the body member surface and will be broken when there is no such contact. Hence by making or breaking the electrical connection between the field intensifying electrode and earth, the field intensifying electrode can be rendered operative or inoperative as desired.

The invention is illustrated by reference to the accompanying drawings in which

Figure 5:
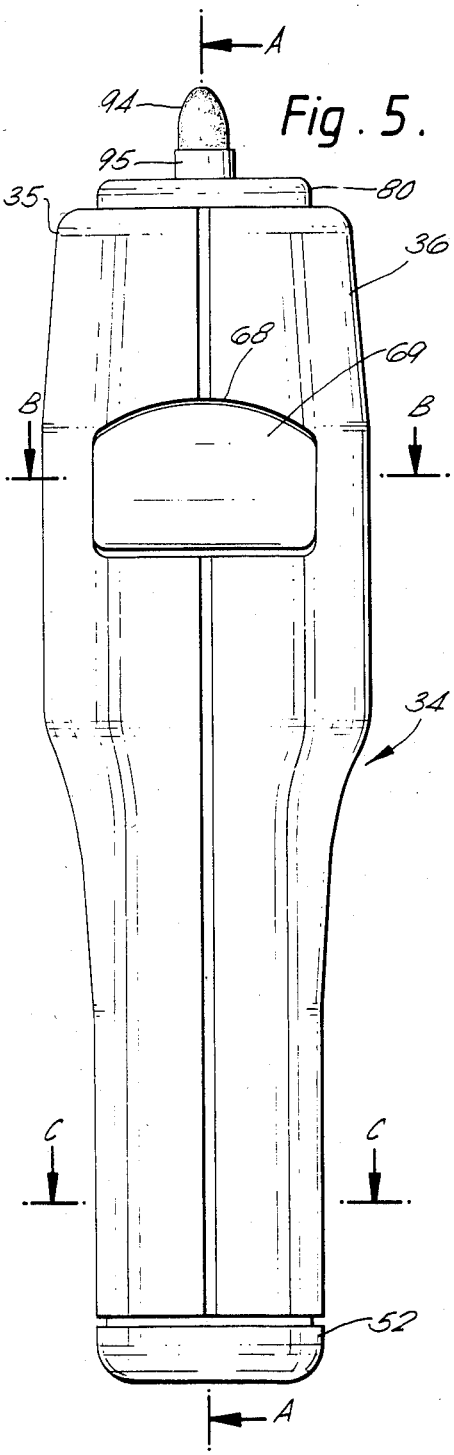
Figure 7:
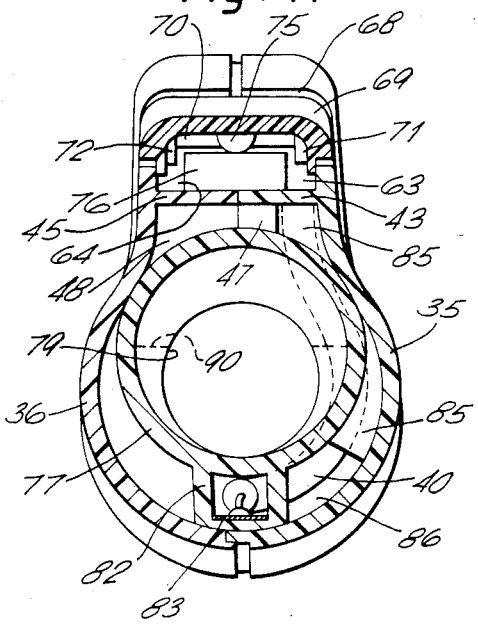
Figure 8:
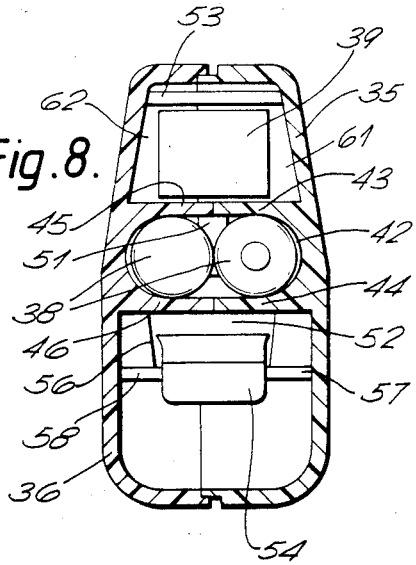
Figure 6:
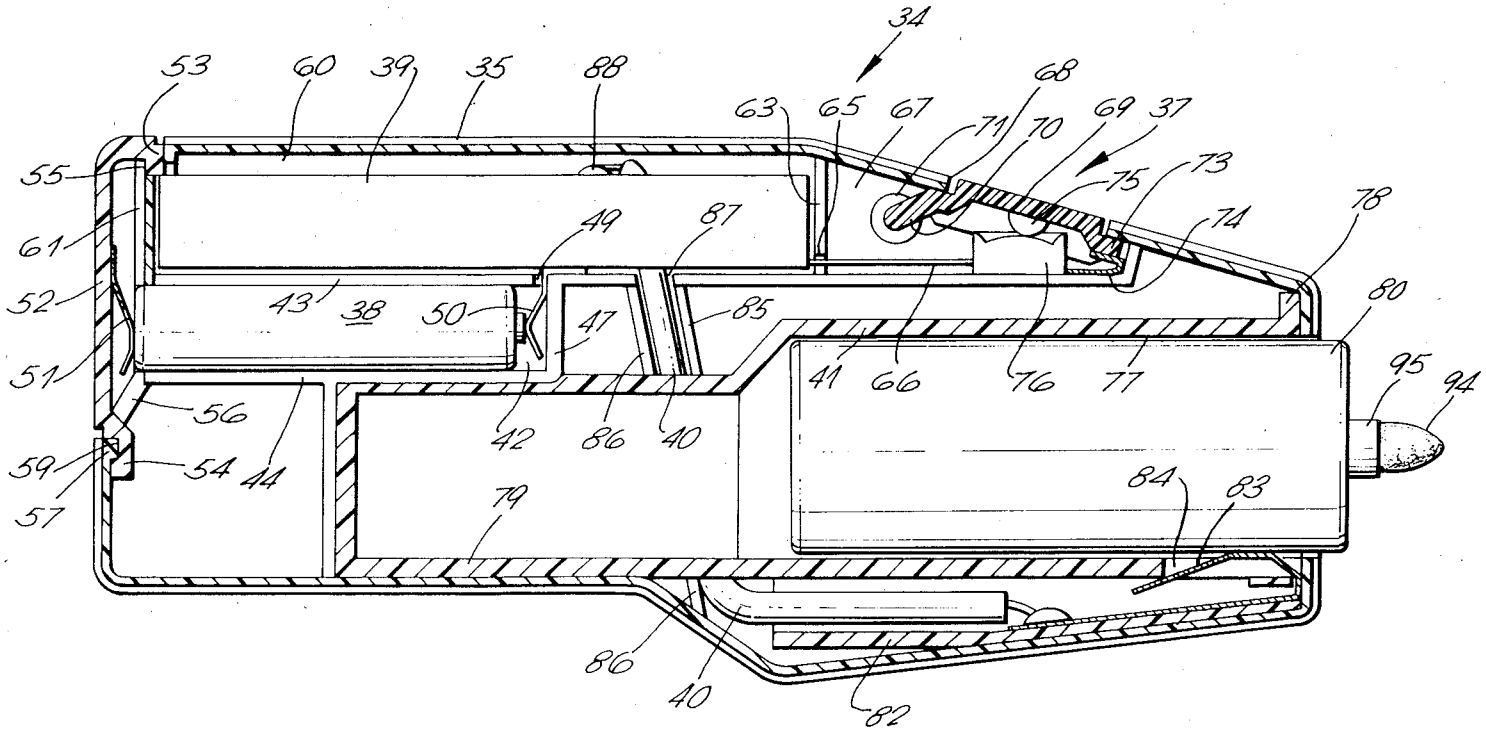
Figure 9:
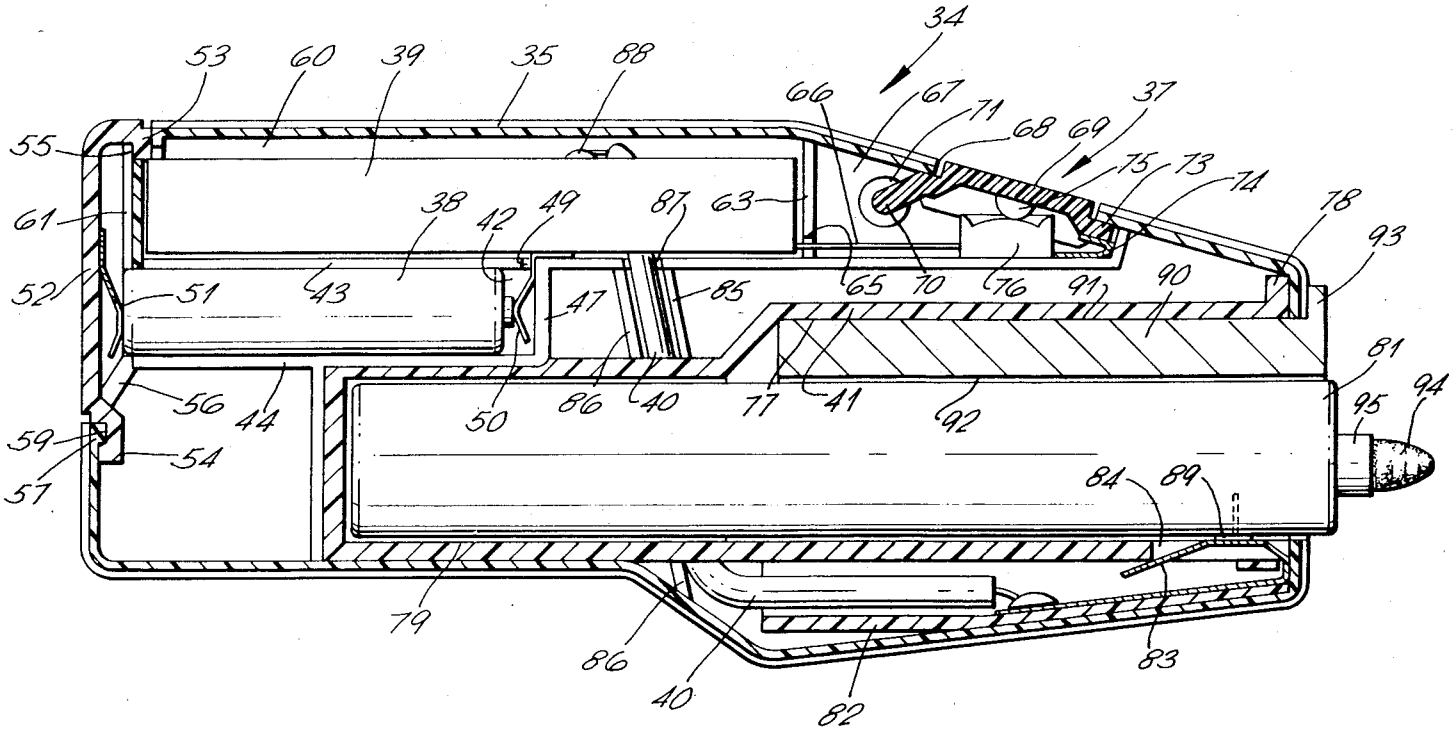

FIG. 5 is a plan view of an alternative embodiment wherein the liquid reservoir and nozzle comprise a demountable cartridge unit, FIG. 6 is a section along the line A—A of FIG. 5, FIG. 7 is a section along the line B—B of FIG. 5 with the cartridge removed, FIG. 8 is a section along the line C—C of FIG. 5, FIG. 9 is a section corresponding to FIG. 6 with an alternative cartridge fitted, together with a suitable adaptor.

Figure 1:
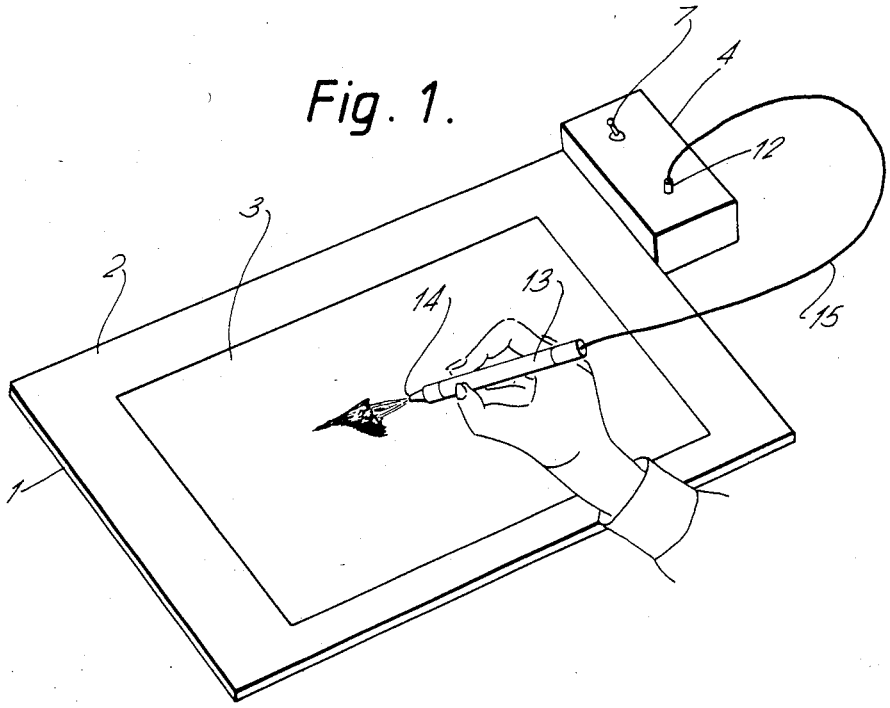
FIG. 1 is a perspective view of one form of the apparatus in accordance with the invention in use.
Figure 2:
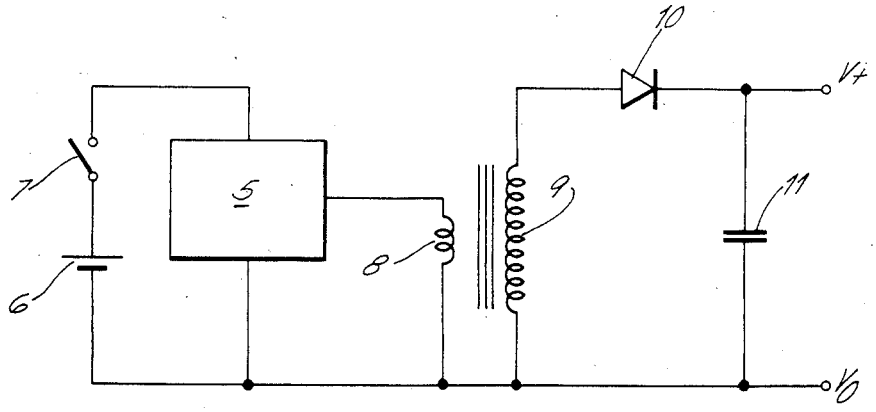
FIG. 2 is a circuit diagram of the high voltage generator used in the apparatus of FIG. 1.
Figure 3:
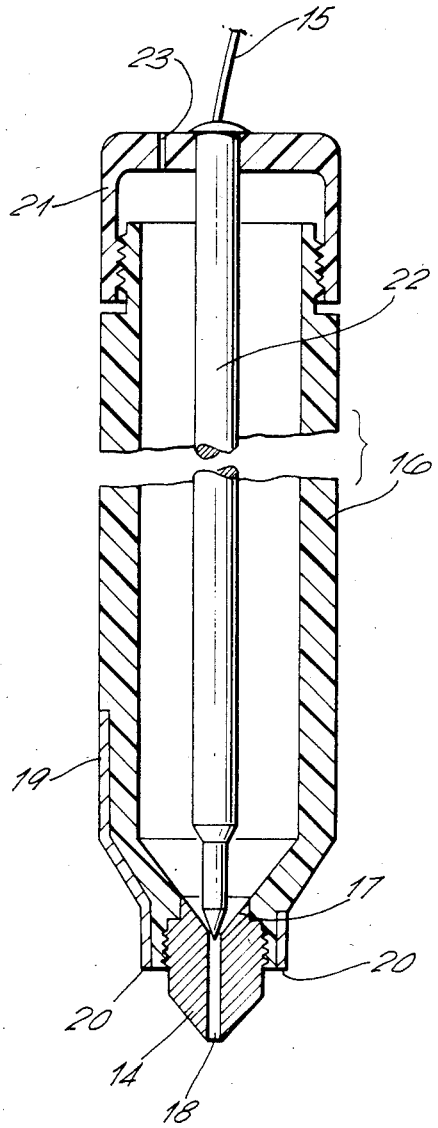
FIG. 3 is a longitudinal section of the applicator used in the apparatus of FIG. 1.

In FIG. 1 there is shown a flat drawing board 1 having a metallised surface layer 2 on which the workpiece 3, e.g. a sheet of paper, is resting. At the right hand side of board 1 is a housing 4 containing batteries and a battery powered high voltage generator. The generator circuit is shown in FIG. 2 and consists of a solid state switching device 5 powered by batteries 6 via an on/off switch 7 mounted on housing 4. The switching device 5 produces pulses which are fed to the primary 8 of a transformer. High voltage pulses are thus produced in the secondary winding 9 of the transformer and are rectified by rectifier 10 and fed to capacitor 11. (Capacitor 11 can in some cases be omitted as described hereinafter). One terminal, Vo, of the generator is connected to the metallised surface 2 of board 1 while the other terminal, V+, is connected to an output socket 12 on housing 4.

Typically the generator is arranged to give an output voltage ranging between 5 and 20 kV at load currents up to 200 nA. and a maximum power output of less than 10 mW.

The applicator 13 consists of an elongated cylindrical pen-shaped implement having a metal nozzle 14 at one end and an imsulated flexible electrical lead 15 connected to the opposite end. In use lead 15 is plugged into socket 12. Provided the capacitance given by lead 15 is sufficient, capacitor 11 can be omitted from the high voltage generator.

The applicator has a body 16 formed from an insulating plastics material which is hollow thus providing a reservoir for the liquid to be sprayed. To the end of body 16 the metal nozzle 14 is screw mounted. Nozzle 14 has a tapered entry region 17, forming a valve seat, connected to a small diameter bore 18. Typically the bore diameter will range between 0.1 and 1.0 mm. Since nozzle 14 is screw fitted to body 16, it can readily be removed for cleaning or replacement by a nozzle having e.g. a different entry region configuration, and/or different bore dimensions.

Surrounding the outer end of body 16 is a metal sleeve 19 which is insulated from nozzle 14. The lower end 20 of sleeve 19 acts as a field intensifying electrode, when connected to the surface 2 of board 1 through the user's body.

The other end of body 16 is provided with a screw threaded cap 21 of insulating material to which a needle 22 is fitted extending down the length of the body 16 to provide a needle valve seating with the entry region 17 of nozzle 14. The flexible lead 15 is connected through cap 21 to the needle 22. Even though the needle 22 is not necessarily in contact with the seating 17, the high voltage will be conducted from needle 22 through the liquid to the nozzle 14.

A small hole 23 is provided in cap 21 to act as an air bleed into the reservoir space within the body 16.

By rotating cap 21 with respect to the body 16, the restriction to flow of the liquid from the reservoir to the nozzle outlet can be varied thus enabling the rate of spraying to be adjusted.

Figure 4:
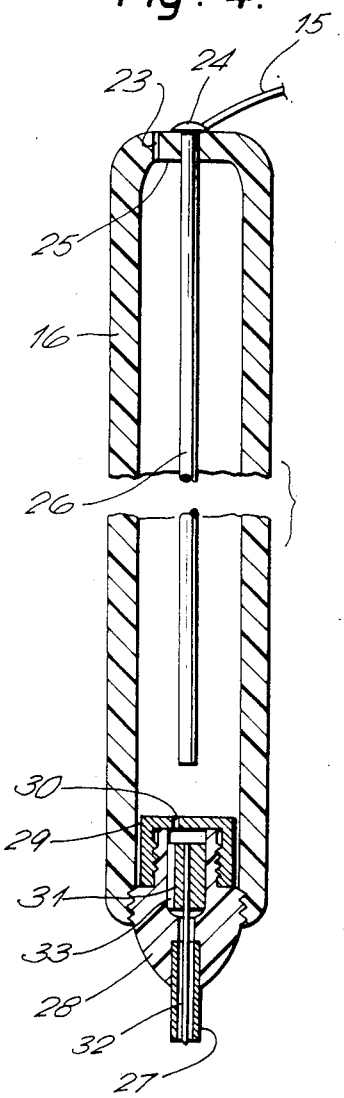
FIG. 4 is a longitudinal section of an alternative applicator.

In an alternative form of applicator shown in FIG. 4, the body 16 has no separate cap but the flexible wire 15 is fastened to a stud 24 passing through the closed end 25 of the body 16. Inside body 16 the stud 24 is connected to a wire 26 extending along the body 16 towards, but ending short of, the other end thereof so that the wire 26 contacts the liquid in the reservoir formed by the hollow interior of the body 16. An air vent 23 is provided in the closed end 25 of body 16. In this embodiment the nozzle assembly comprises a metal tube 27 attached to a moulding 28 of an insulating plastics material screwed on to the lower end of body 16. Screwed on to the inner end of moulding 28 is a cap 29 provided with an orifice 30 to permit flow of liquid from the hollow interior of body 16. Mounted inside moulding 28, and retained by cap 29, is a fluted slide member 31 into which a wire 32 is mounted so that it extends axially along tube 27. The flutes 33 of slide member 31 enable the liquid to flow past member 31 to tube 27.

The passage between wire 32 which typically has a diameter of 0.2 mm, and the tube 27, which typically has an interior diameter of 0.3 mm, thus forms an annular passage for liquid to be sprayed. Since wire 32 is capable of longitudinal movement, cleaning of this passage is facilitated by engagement of the end of tube 27 with a scrap of material, e.g. paper, to depress wire 32.

In an example, an applicator of the type shown in FIG. 4 was charged with Indian ink and connected as shown in FIG. 1 to a high voltage generator giving a maximum voltage of 8 kV. Ink sprayed from the nozzle when the latter was 5 to 20 mm from a sheet of paper lying on the metal surfaced board. At the maximum current drawn from the generator during spraying, the generator output voltage fell to about 7 kV between pulses.

When a mask consisting of a piece of non-conducting plastics film was placed over part of the workpiece, spraying ceased when the nozzle was over the masked areas. The mask was held firmly in place by electrostatic attraction.

In the embodiment of FIGS. 5 to 9, the apparatus is self contained and employs a cartridge unit for the liquid reservoir and nozzle. The cartridge is conveniently a felt-tipped marker. The apparatus of this embodiment is designed to accomodate, with the use of an adaptor, cartridges of different shapes and/or sizes.

The apparatus comprises a body 34 constructed from two shell mouldings 35, 36 formed from an electrically insulating plastics material. These mouldings may be held together by any suitable means, for example adhesive along the mating surfaces.

Within the shell formed by mouldings 35, 36, interior partitions define housings for a switch assembly 37, batteries 38, a high voltage generator 39 and a high voltage lead 40 therefrom. Also mounted within the shell is a cartridge housing 41.

The generator 39 is powered, via switch assembly 37, from two 1.5 V dry batteries 38 located within a housing 42. The top and bottom of housing 42 are formed by partitions 43, 44 and 45, 46 integral with mouldings 35 and 36 respectively. The front end of the housing is likewise formed by partitions 47, 48 integral with mouldings 35, 36.

Adjacent the front end of the battery housing 42 are a pair of spring metal contact strips which project through slots 49 in the partitions 43, 45 forming the top of the battery housing 42. One of these contact strips is designated by the reference numeral 50 in FIG. 6.

The batteries are held in place, and connected in series, by a spring metal contact strip 51 at the rear of the battery housing 42. This contact strip 51 is mounted on a cover plate 52 moulded from an electrically insulating plastics material.

Cover plate 52 is provided with lugs 53, 54 at its upper and lower ends. These lugs engage, through upper and lower slots 55, 56 in the shell mouldings, with the shell mouldings to hold cover plate 52 in position. The shell mouldings 35, 36 are provided with ribs 57, 58 adjacent the lower edge of the lower slot 56. A recess 59 in the lower lug 54 of the cover plate 52 engages with ribs 57, 58.

Cover plate 52 can be removed, for changing the batteries 38, by pressing inwards against the spring pressure of contact 51, to disengage recess 59 of lug 54 from the ribs 57, 58 and then sliding the cover plate 52 upwards to disengage lug 53 from the upper slot 55.

The generator 39 is of the type shown in FIG. 2 and is located within an enclosure 60 between the top of shells 35, 36 and the partitions 43, 45 thereof forming the top of the battery enclosure 42. The rear of the generator enclosure 60 is formed by the ends 61, 62 of the shell mouldings 35, 36 respectively while the front is formed by partions 63, 64 integral with mouldings 35, 36 respectively.

Slots 65 are provided in partitions 63, 64 to allow two rigid leads 66 from the generator 39 to pass through the partitions 63, 64 to the switch enclosure 67.

The battery spring contact 50 is connected directly through slot 49 to generator 39 while the other battery spring contact (not shown) at the front of the battery housing 42 connects with one of the rigid leads 66 projecting through slots 65.

The switch enclosure 67 is formed by partitions 43,45 and 63, 64, and the front upper portion of shell mouldings 35, 36. An opening 68 is provided in mouldings 35, 36 into which projects a button 69 moulded from an electrically conductive plastics material. Button 69 is pivotally mounted, by means of an integral lug 70, in bosses 71, 72 integral with mouldings 35, 36. The front end of button 69 bears a lug 73 which is urged against the underside of the front upper portion of mouldings 35, 36 adjacent opening 68 by a spring metal contact strip 74. Button 69 also carries on its underside an integrally formed projection 75 which bears against a non-latching push-to-make switch 76.

Switch 76 is supported by rigid leads 66. One of these leads also connects to contact 74. On closing switch 76 by pressing button 69, the electrical connection from batteries 38 to generator 39 is completed, thus providing power to the generator.

Mounted within the shell mouldings 35, 36 is a cartridge housing 41 moulded from an electrically insulating plastics material. Housing 41 comprises a first hollow cylindrical portion 77 provided at its front end with a flange 78 which abuts the interior front end of shell mouldings 35, 36, and a second hollow cylindrical portion 79 of reduced diameter forming a rearward extension of the first cylindrical portion 77. The first cylindrical portion 77 is of such internal dimensions that it can receive a cylindrical cartridge 80, of short, squat, configuration with one end of the cartridge projecting from the front of the shell mouldings 35, 36.

As is shown in FIG. 9, the second cylindrical portion 79 is of such internal dimensions that it can receive a longer cartridge 81 of reduced cross-section.

Housing 41 also has an integrally formed sleeve 82 in which a spring metal contact strip 83 is mounted, soldered to the end of the high voltage lead 40 from generator 39. The contact strip 83 projects through a slot 84 in the base of the first cylindrical portion 77 of housing 41 to contact the casing of the cartridge 80 inserted therein.

High voltage lead 40 is led, from contact strip 83, behind the rear of the first cylindrical portion 77 of housing 41, round the outside of the second cylindrical portion 79 of housing 41, between partitions 85, 86 integrally formed in shell moulding 35, into the generator enclosure 60 through a slot 87 in partition 43. The high voltage lead 40 connects to the high voltage generator at the high voltage output terminal 88 on the top of generator 39. Part of the path of lead 40 is shown dotted in FIG. 7.

In the arrangement shown in FIGS. 5 and 6 the cartridge 80 has a metal casing. In the embodiment of FIG. 9 however the cartridge 81 has a casing of a non-conducting plastics material. In order to make electrical contact with the liquid in cartridge 81, a metal drawing pin 89 is pressed through the cartridge walls at such a position that the head of pin 89 will contact the contact strip 83.

When using the longer, thinner, cartridge 81, in order to hold it in position an adaptor 90 is employed. (This adaptor is shown dotted in FIG. 7). The adaptor 90 has an upper surface 91 shaped to fit within the first cylindrical portion 77 of housing 41, a lower surface 92 corresponding to that of the second cylindrical portion 79 of housing 41, and a flange 93 at the front to abut against the front of shell mouldings 35, 36.

The cartridges 80, 81 are of the type having a felt- or fibre-tip 94 projecting from a support 95 at one end of the cartridge. Normally the casing of the cartridge encloses a wad or strip of porous material impregnated with liquid.

In use, a cartridge containing the liquid to be sprayed in inserted in housing 41, if necessary with an adaptor and/or a contact through the cartridge casing, and then button 69 is depressed. This causes a high potential to be applied from generator 39, via high voltage lead 40 to contact strip 83 and hence to the nozzle 94 via conduction through or over the cartridge casing.

When positioned sufficiently close to an earthed surface, the liquid in the cartridge is atomised from the felt- or fibre-tip nozzle 94 as a spray of fine, electrically charged droplets. The return path to the generator is formed by condensation through the user contacting button 69, which, being electrically conductive, provides a connection from earth, via the user, to spring contact 74 and hence, via switch 76, to the generator.

In the following Examples, apparatus of the type shown in FIGS. 5–9 was employed. The body member, which could be held between the thumb and forefinger, with the latter resting on button 69, had a total length of about 14 cm, a maximum height of 63 mm and a maximum width of 39 mm.

EXAMPLE 1

A standard "Magic Marker" (RTM) felt-tip marker from the Studio Colours range (colour A 310 cadmium red) was fitted into the body member as shown in FIG. 6. The marker had a metal cap which contacted contact strip 83. The felt-tip on the marker as supplied had a chisel configuration 3 mm thick and 6 mm deep. The generator, which produced high voltage pulses at a frequency of about 20–25 Hz, provided a voltage of about 12 kV at the tip when the button 69 was depressed.

With the tip held at distances 2, 3 and 4 cm above a piece of paper resting on a wooden desk, ink sprayed from the nozzle.

EXAMPLE 2

Example 1 was repeated but replacing the standard felt-tip by a cylindrical polyester fibre-bundle tip of 3.7 mm diameter with its end shaped to the bullet-head configuration shown in FIGS. 5, 6 and 29. When held with the tip 2, 3 and 4 cm above the paper, on pressing button 69 a more intense spray was obtained than in Example 1.

EXAMPLE 3

Example 2 was repeated with the addition of 1 ml of xylene to the wadding inside the marker to dilute the ink therein. This ink dilution increased the flow rate and the spray intensity.

EXAMPLE 4

Example 2 was repeated with similar results, using the following Studio Colour range "Magic Markers" fitted with the bullet head tips:

Fuschia A 348
Forest Green A 600
Cobalt Blue A 455
Africano A 262
Cadmium Yellow A 704

EXAMPLE 5

To assess the effect of varying the voltage, and to measure the spray current, the generator in the applicator was disconnected and a high voltage applied to contact strip 83 via a flexible high voltage lead from a remote variable voltage generator. The other terminal of the generator was earthed. To measure the current, the tip was positioned above a metal plate connected to earth via a digital meter.

Example 3 was repeated with the tip at 3.5 cm from the plate. At an applied voltage of 12 kV the current was 19 nA while at 15 kV the current was 60 nA. With 15 kV applied voltage the tip was gradually moved away from the plate. A spray was still obtained with the tip 9 cm from the plate. With an applied voltage of 9.5 kV good sprays were obtained with the tip between 1 and 7 cm from the plate.

EXAMPLE 6

Example 1 was repeated using a standard "Pantone" (RTM) felt-tip pen type "Warm Red M" in place of the "Magic Marker": in this case adaptor 90 was employed. The pen had a plastic body and a chisel-edge felt-tip of 6 mm width.

Using a generator applying 11.8 kV to strip 83, the voltage at the tip was only 6.2 kV. Only a very faint spray was found with the tip held at 2 cm from the paper but the intensity increased as the tip was brought closer (to within 1 cm) of the paper.

EXAMPLE 7

Example 6 was repeated but, to improve the conduction of the high voltage from strip 83 to the felt-tip, a metal drawing pin was pressed through the pen casing at the position of contact 83. In this case the voltage at the tip was 11.5 kV. The spray intensity was greater than in Example 6.

EXAMPLE 8

Example 7 was repeated but with the felt-tip replaced by a polyester fibre bundle bullet-head tip of diameter 4.8 mm and using a generator producing 14 kV at strip 83 (13.9 kV at the felt-tip). A more intense spray was obtained than in Example 7.

EXAMPLE 9

Example 6 was repeated using the felt-tip used in Example 8 and adding 1.5 ml of xylene to the cartridge contents.

Good spraying was obtained at distances up to 7 cm from the paper.

EXAMPLE 10

Example 1 was repeated using a standard "Textmark" (RTM) 700 blue ink marker. As in Example 6 an adaptor was employed to hold the marker in position. The marker had a metal casing and a bullet-head configuration tip formed of an acrylic fibre bundle of about 4 mm diameter.

With an applied voltage of 14 kV, satisfactory spraying was obtained at distances of 2, 3 and 4 cm from the paper.

EXAMPLE 11

Example 5 was repeated using the marker of Example 10 with the tip at varying distances from the plate. The measured current was as follows:

| Distance from paper (cm) | Voltage (kV) | Current (nA) |
|---|---|---|
| 5 | 10 | 84 |
| 10 | 10 | 50 |
| 15 | 10 | 9 |
| 5 | 15 | 3000 |
| 10 | 15 | 1080 |
| 15 | 15 | 350 |

Under all the conditions quoted, satisfactory spraying occurred.

All the markers employed in Examples 1 to 11 could be used conventionally by moving the tip in contact with paper.

EXAMPLE 12

An empty "Magic Marker" type 79 in which the tip supplied has been sharpened to a point was charged with an alcohol based aftershave. When fitted to the applicator body provided with a generator producing high voltage pulses at a frequency of about 20–25 Hz, giving a voltage of about 12 kV at the tip, a spray could be dispensed into the atmosphere. The user's finger on button 69 acted as a field intensifying electrode to permit spraying even though no other earthed surface was within 50 cm of the tip.

Aftershave could also be deposited on the user's chin by holding the tip a few cm from the chin, or by moving the tip over the skin while in contact therewith.

EXAMPLE 13

An empty "Magic Marker" of the type used in Example 12 was charged with a vegetable oil based pesticide. When fitted to the applicator body as in Example 12, a pesticide spray could be dispensed on to houseplants when held within 10 cm of the plant. The pesticide could also be dispensed by wiping the tip on the houseplant leaves.

All the cartridges of Examples 1 to 13 were such that no liquid was dispensed when no high potential was applied and the tip was not in contact with a receptive surface such as paper.

We claim:

1. Apparatus for spraying a liquid comprising (i) freely movable elongated body member, suitable for holding in the human hand, provided with a nozzle at one end, (ii) means for delivering the liquid to said nozzle, (iii) a high voltage generator, (iv) means for applying a sufficiently large electrical potential, relative to earth, from said generator to said nozzle that, when said body member is held in the human hand with the nozzle at a distance of 2 cm above an earthed surface, sufficient electrical gradient is provided at said nozzle to atomise said liquid as a spray of electrically charged droplets, said nozzle and said means for delivering the liquid thereto being of the type that, when said nozzle is in contact with a surface beneath the nozzle that is receptive to said liquid and is moved relative to, but in contact with, said surface, liquid is transferred from said nozzle onto said surface, but when said nozzle is disposed above, but out of contact with, a surface and no atomising electrical potential is applied to said nozzle, no liquid is dispensed from said nozzle.

2. Apparatus according to claim 1 wherein said nozzle comprises a wick of porous material protruding from a support.

3. Apparatus according to claim 1 wherein said nozzle is demountable from said body member.

4. Apparatus according to claim 1 wherein the means for delivering the liquid to the nozzle comprises a reservoir of said liquid within said body member, said reservoir being demountable from said body member.

5. Apparatus according to claim 4 wherein the reservoir and nozzle comprise a single cartridge unit which can be removed from the body member.

6. Apparatus according to claim 5 wherein said cartridge unit is a graphic marking implement.

7. Apparatus according to claim 5 wherein said body member is adapted to receive cartridges of more than one shape and/or size.

8. Apparatus according to claim 1 wherein the high voltage generator is mounted within the body member.

9. Apparatus according to claim 8 wherein the outer surface of said body member is provided with an electrically conductive portion electrically connected to the high voltage generator thereby providing an earth return to said generator when said electrically conductive portion is contacted by the hand of the user.

10. Apparatus according to claim 9 wherein the high voltage generator is powered by at least one battery provided within said body member.

11. Apparatus according to claim 9 wherein said electrically conductive portion comprises a push button which, when depressed, causes a high potential, relative to earth, to be generated by said generator.

12. Apparatus for use in the spraying of a liquid from a cartridge having a casing enclosing a reservoir of the liquid and a nozzle of the type that, when said nozzle is in contact with a surface beneath the nozzle that is receptive to said liquid and is moved relative to, but in contact with, said surface, liquid is transferred from said nozzle on to said surface, but, when said nozzle is disposed above, but out of contact with, a surface and no atomising potential is applied to said nozzle, no liquid is dispensed from said nozzle, comprising (i) freely movable elongated body member, suitable for holding in the human hand, and adapted to receive said cartridge with the nozzle thereof projecting from one end of said body member, (ii) a high voltage generator, and (iii) means to apply a sufficiently large electrical potential, relative to earth, from said generator to said cartridge, when said cartridge is fitted to said body member, that, when said body member is held in the human hand with the nozzle of the cartridge at a distance of 2 cm above an earthed surface, sufficient electrical gradient is provided at the nozzle to atomise said liquid as a spray of electrically charged droplets.

13. Apparatus according to claim 12 wherein said body member is adapted to receive cartridges of more than one shape and/or size.

14. Apparatus according to claim 12 wherein the high voltage generator is mounted within the body member.

15. Apparatus according to claim 14 wherein the outer surface of said body member is provided with an electrically conductive portion electrically connected to the high voltage generator thereby providing an earth return to said generator when said electrically conductive portion is contacted by the hand of the user.

16. Apparatus according to claim 15 wherein the high voltage generator is powered by at least one battery provided within said body member.

17. Apparatus according to claim 15 wherein said electrically conductive portion comprises a push button which, when depressed, causes a high potential, relative to earth, to be generated by said generator.

* * * * *